US007097738B2

(12) United States Patent
Rousu et al.

(10) Patent No.: US 7,097,738 B2
(45) Date of Patent: Aug. 29, 2006

(54) PROCESS FOR PRODUCING PULP

(75) Inventors: Esa Rousu, Oulu (FI); Pasi Rousu, Oulu (FI); Juha Anttila, Oulu (FI); Päivi Rousu, Oulu (FI)

(73) Assignee: Chempolis Oy, Oulu (FI)

( * ) Notice: Subject to any disclaimer, the term of this patent is extended or adjusted under 35 U.S.C. 154(b) by 135 days.

(21) Appl. No.: 10/483,700

(22) PCT Filed: Jul. 11, 2002

(86) PCT No.: PCT/FI02/00629

§ 371 (c)(1),
(2), (4) Date: Jan. 13, 2004

(87) PCT Pub. No.: WO03/006737

PCT Pub. Date: Jan. 23, 2003

(65) Prior Publication Data

US 2004/0231810 A1 Nov. 25, 2004

(30) Foreign Application Priority Data

Jul. 13, 2001 (FI) ..... 20011541

(51) Int. Cl.
*D21C 3/04* (2006.01)
*D21C 11/10* (2006.01)
*D21C 5/00* (2006.01)

(52) U.S. Cl. ..... 162/76; 162/30.1; 162/32; 162/72; 162/99; 162/37

(58) Field of Classification Search ..... 162/16, 162/37, 39, 76, 14, 29, 32, 38, 40, 70, 91, 162/99, 35, 30.1, 72
See application file for complete search history.

(56) References Cited

U.S. PATENT DOCUMENTS 4,155,804 A * 5/1979 Edge, Jr. ..... 162/16
5,788,812 A * 8/1998 Agar et al. ..... 162/16
6,139,683 A * 10/2000 Nimz et al. ..... 162/19

FOREIGN PATENT DOCUMENTS

WO WO 9910595 A1 * 3/1999
WO WO 9957364 A1 * 11/1999

OTHER PUBLICATIONS

Lehnen, et al, Furfural and Hydroxymethylfurfural as Byproducts of FORMACELL Pulping, 2001, Holzforschung, vol. 55, No. 2, pp. 199-204.*

Saake et al., "Production of dissolving and Paper grade pulps by the formacell process," The 8th International Symposium on Wood and Pulping Chemistry, Jun. 6-9, 1995, Helsinki, Finland, Proceedings, vol. II, pp. 237-242.

Database WPI, Week 198603, Derwent Publications Ltd., London, GB; AN 1986-019485 & SU 1164347 A (Leningrad Forestry Acad), Jun. 30, 1985 abstract.

Saake, B., Production of Pulps by Formacell Process, Das Papier, vol. 49, No. 10A, V1-7, ABIPC abstract No. 6617371.

Saake, B., Production of Dissolving and Paper- Grade Pulps by the Formacell Process, Meeting info.: International Symposium on Wood and Pulping Chemistry, Helsinki, Finland, Jun. 6-9, 1995, pp. 237-242, ABIPC abstract No. 6617370.

Zeitsch, "the chemistry and technology of furfural and its many by-products," Sugar Series, 13, pp. 19-20, 2000.

Dunlop et al., "The Furans," American Chemical Society Monograph Series, pp. 394-395, 1953.

* cited by examiner

*Primary Examiner*—Steven P. Griffin
*Assistant Examiner*—Anna L. Kinney
(74) *Attorney, Agent, or Firm*—Alston & Bird LLP

(57) ABSTRACT

The invention relates to a process for producing pulp from a fibre-based raw material using, as the cooking reagent, a solvent mixture which is based on organic acids and also contains furfural. The method is applicable to herbaceous plants, in particular.

27 Claims, No Drawings

PROCESS FOR PRODUCING PULP

CROSS-REFERENCE TO RELATED APPLICATIONS

This application is a national stage filing of International Application PCT/F102/00629 filed on Jul. 11, 2002, which designated the U.S. and was published under PCT Article 21(2) in English, and which is hereby incorporated herein in its entirety by reference.

BACKGROUND OF THE INVENTION

The invention relates to pulp production processes which are based on organic chemicals and where herbaceous plants, particularly grain straw, are used as raw material.

Using existing processes for producing chemical cellulose, cellulose pulp can be produced in an economical and environmental friendly manner when wooden raw materials are employed. However, one has not, either technically or economically, succeeded in producing cellulose that would satisfy the environmental requirements from herbaceous plants, i.e. non-wood materials.

To eliminate the environmental effects of chemical pulp production, 'organosolv' processes based on organic cooking solvents have been devised. The organosolv processes are based on the utilization of organic solvents, typically organic acids, in delignification. Several of these processes are based on sulphur-free and chlorine-free chemicals, which can be regarded as the requirement for the industrial implementation of closed circulation of chemicals. Such processes are described e.g. in WO 96/26403 (Chempolis Oy) and WO 00/60160 (Chempolis Oy).

Non-wood material is most preferably delignified in acid conditions. In that case the silicon included in the non-wood material is in a very poorly soluble form and does not thus cause problems in the recovery of chemicals. In alkaline cooking processes, instead, silicon dissolves into the cooking liquor and causes problems. For this reason, the most environmental friendly and economical way of implementing delignification is to carry it out by organic solvents in acid conditions. It is particularly preferable to utilize a process where chemicals to be used in the cooking are formed in the process itself.

Several organosolv processes have been reported to produce furfural during the production of cellulose. In general, it has been argued that production of furfural in acid conditions impedes delignification because furfural may react with lignin and other compounds of the plant material, forming caramel-like polymers. This was noticed e.g. in an organosolv process based on acetic acid (Zil'bergleit, M. A. & Glushko, T. V., Products from the Polymerization of Furfural and Hydroxymethylfurfural in Acetic Acid, Khimia Drevesiny (Riga), 1991, no 1, 66–68) and in acid preliminary hydrolysis of the M. A., New Process of Preliminary Hydrolysis, Bumaznaja promyslennost, 1982, no 9, 12–13). It has been found that furfural also reacts in the sulphite cooking, causing pulp blackening (Oblak-Ramer, M., Budin, D. & Lipic, B., Concerning the basics of condensation of lignins in magnesium bisulphite digestion. Part 1. Influence of processing time, temperature and thiosulphate, Zellstoff und Papier 40 (1991), no. 1, 10–13). Utilization of furfural in the actual delignification process has not been described in the literature related to the art; instead, furfural has usually been separated from the process. For example, it has been suggested that the furfural separated from the Alcell process (WO 93/15261, Lora et al.) and the Formacell process (Lehnen, R., Saake, B. & Nimz, H. H., Furfural and Hydroxymethylfurfural as Byproducts of FORMACELL Pulping, Holzforschung 55 (2001), no. 2, 199–204) be utilized as a commercial product.

It has been found earlier that high-quality cellulose pulp can be produced advantageously using a mixture of formic acid, acetic acid and water in delignification (WO 99/57364, Chempolis Oy). Surprisingly, it has now been found that pulp can be produced from a delignification mixture based on organic acids using also furfural.

BRIEF DESCRIPTION OF THE INVENTION

The object of the invention is to improve the pulp production process based on organic acids. The invention is based on dissolving lignin from a fibre-based raw material using furfural in delignification in addition to organic acids.

It was found that the pulp yield could be improved by using furfural, which also facilitated the recovery of chemicals. The hemicellulose content of cellulose pulp can be increased without changing the pulp lignin content. In that case the yield and properties of pulp will improve. The chemicals to be used in the process, i.e. organic acids and furfural, are formed during the actual process, especially during the recovery step of the cooking chemicals, which makes the process even more advantageous.

DETAILED DESCRIPTION OF THE INVENTION

The invention relates to a process for producing pulp from a fibre-based raw material, comprising a cooking step using a cooking reagent based on organic acids at a temperature of 105 to 160° C. and a recovery step of said cooking reagent. The process is characterized in that the cooking reagent used for delignification also includes furfural, which is derived from the recovery step of said cooking reagent.

The process of the invention is applicable in connection with various organic acids and their mixtures. Typically, formic acid, acetic acid or their mixture is used. In addition to the organic acids, the cooking reagent usually contains water. The contents of the organic acid are typically from 0 to 90%, calculated from the total weight of the cooking reagent, and the acid may be formed of formic acid, acetic acid or their mixture. When a mixture of formic acid and acetic acid is used as the cooking reagent, it preferably contains 40 to 80% of formic acid and 8 to 50%, preferably 8 to 40% and most preferably 8 to 35% of acetic acid, calculated from the total weight of the cooking reagent.

According to the present invention, the cooking reagent also includes furfural. The furfural content is typically 0.01 to 10%, preferably 1.0 to 7.5%, calculated from the total weight of the cooking reagent. In practice, the furfural formed in the process compensates for the acid losses of the process and reduces the amount of make-up acid. The optimal furfural content is 2.5 to 7.5%, calculated from the total weight of the cooking reagent. Higher furfural amounts can also be used but in that case the cooking usually needs to be enhanced e.g. by raising the cooking temperature or by increasing the cooking time.

In addition to furfural, the cooking reagent may also contain other furan compounds.

Furfural is formed in the actual process, typically in the recovery phase of cooking chemicals. In a typical situation, the cooking liquor that has been recovered from the process and concentrated with respect to the dissolved solids is allowed to react at an elevated temperature. In that case the organic matter, such as hemicellulose and lignin, included in the cooking liquor reacts, producing furfural as well as cooking chemicals to be used in the process, i.e. formic acid and acetic acid, as reaction products. The acids may be utilized as such in the cooking. According to the invention, it has been surprisingly found that furfural obtained as a reaction product can also be utilized in the cooking. Thus the furfural needs not be separately isolated from the mixture of cooking acids but the furfural-containing mixture can be used as such in the cooking. This reduces the load on the separation section of the process.

The temperature used for the reaction of the concentrated cooking liquor is typically 50 to 250° C.

Furfural is carried to the cooking with acids in the recovery process of cooking chemicals, i.e. cooking acids. The recovery of cooking acids typically comprises evaporation, drying/separation of lignin and concentration of acids by distillation.

The recovery system of cooking chemicals typically comprises an evaporation step where the used cooking liquor obtained from the separation of cooking liquor and pulp is evaporated. The evaporation can be carried out at a temperature of 50 to 180° C. under a reduced pressure or an overpressure. As condensate, the evaporation yields a concentrated mixture containing formic acid and acetic acid, which is returned to the cooking, and an evaporation concentrate where acetic acid, formic acid and furfural have formed during the evaporation from the organic matter of the cooking liquor and/or organic acids included in the organic matter. The dry solids content of the evaporation concentrate is typically 20 to 85%, particularly 40 to 80%. More formic acid, acetic acid and furfural can be formed in the evaporation concentrate thus obtained by allowing it to react at an elevated temperature (e.g. 50–250° C.) without evaporation. The reaction time can be 0,5 min to 24 h, for example. According to the present invention, it has been found that furfural can also be utilized in the cooking, and thus the furfural-containing acid mixture obtained can be used as such in the cooking without separating the furfural.

It is also feasible to separate the mixture thus obtained that includes furfural, formic acid, acetic acid and water into different fractions e.g. by distillation. In that case furfural, a mixture of formic acid and acetic acid, and water are obtained as distillation fractions. The mixture of formic acid and acetic acid is returned to the cooking for use as cooking acid. The furfural fraction obtained can also be returned to the cooking for use as the furfural component of the cooking reagent.

In the process according to the invention, the cooking time is typically 20 to 120 min and the cooking temperature 105 to 160° C., preferably 105 to 150° C., most preferably 105 to 140° C. The use of furfural as a component of the cooking reagent does not substantially increase the cooking time or raise the cooking temperature.

A typical ratio of the cooking reagent to the raw material is 2.5:1–10:1.

Where high formic acid contents are used in the cooking, formic acid binds to the pulp as formiate esters, i.e. the cellulose pulp is formylated. Formiate esters can be hydrolyzed utilizing the catalytic activity of formic acid. In a typical situation, the formic acid chemically bound to the pulp is reacted into free formic acid at a temperature of 50 to 95° C., the original content of free formic acid being 3 to 20%. The process is carried out at the normal pressure, and the reaction time is 0,5 to 4 h, for example.

When acetic acid is used in the cooking, the pulp is acetylate. This has been found in organosolv processes based on acetic acid (e.g. Pan, X–J. & Sano, Y., Atmospheric Acetic Acid Pulping of Rice Straw IV: Physico-Chemical Characterization of Acetic Acid Lignins from Rice Straw and Woods, Hoirforsehung 53 (1999). 590–596, and Saake, B., Lebnen, R., Lurnmitsch, S. & Nimz, H. H., Production of Dissolving and Paper Grade Puips by the Formaceli Process. Proceedings of the 8$^{th}$ International Symposium on Wood and Pulping Chemistry, Helsinki 1995, 2:237–242). The acetylation degree is proportional to the acetic acid content used. The more acetic acid is used in the cooking, the more acetate esters are formed in the pulp. The acetate esters have to be hydrolyzed for the recovery of bound acetic acid. Saponification, i.e. alkaline hydrolysis, has been suggested as a feasible process for recovering acetic acid (Pan, X14 J. & Sano, Y., Atmospheric Acetic Acid Pulping of Rice Straw LV: Physico-Chemical Characterization of Acetic Acid Lignins from Rice Straw and Woods, Holzforschung 53 (1999), 590–596, and Saake, W, Lehnen, R, Lummitsch, S. & Nimz, H. H., Production of Dissolving and Paper Grade Puips by the Formacell Process. Proceedings of the 8$^{th}$ International Symposium on Wood and Pulping Chemistry, Helsinki 1995, 2:237–242). In that case, however, the hydrolyzed acetic acid reacts into acetate salts corresponding to the alkali, for which reason the acetic acid cannot be directly re-used.

The process of the invention may thus also include a step where oganic acids chemically bound to the pulp are released by reacting the pulp at a temperature of 50 to 120° C. when the content of free acids is 2 to 90%. In that case formiate esters and acetate esters react into free formic acid and free acetic acid.

The hydrolysis of acetate esters, however, requires a longer reaction time than the hydrolysis of formiate esters. For this reason, the acetate esters are preferably hydrolyzed e.g. in a pulp storage container, where the retention time is sufficiently long.

The pulp de-esterification is typically carried out during pulp washing in a pulp container between the washing steps.

The chemically bound organic acids included in the organic matter, typically lignin, separated from the pulp can also be released in the same manner. Thus the process of the invention may also include a step where the chemically bound organic acids included in the organic matter separated from the pulp are released by reacting the organic matter at a temperature of 50 to 180° C. when the content of free acids is 2 to 90%.

The de-esterification of organic matter, typically lignin, is carried out on the concentrate obtained from the evaporation of the cooking liquor or during the evaporation.

The chemically bound acids included in the lignin separated from the pulp can also be released into the cooking liquor during precipitation of lignin using the wash acid obtained from the pulp washing or some other diluted acid or water. The precipitation of lignin is carried out on the cooking liquor for example when lignin and hemicellulose are to be recovered separately.

According to the invention, it has been surprisingly found that the total yield of pulp increases when organic acids are partly replaced by furfural in the cooking. On the other hand, addition of furfural to the cooking liquor slows down the delignification to some extent. Cooking of the pulp up to a desired lignin content is achieved e.g. by increasing the cooking time or by raising the cooking temperature. Furfural does not seem to have a significant effect on the paper-technical properties of pulp.

The use of furfural as part of cooking chemicals according to the present invention has an advantageous effect on the recovery of chemicals, too. The recovery of cooking chemicals typically comprises separation steps, e.g. distillation where a mixture of cooking acids, furfural and water is separated into acid, water and furfural fractions. When part of the acids used in the cooking are replaced by furfural, the feed flow can be decreased at the distillery and the investment and operation costs of the distillery reduced. In addition to the fact that furfural can be employed as a cooking chemical according to the present invention, it can be utilized as the additive of distillation to facilitate the separation of water and acids. Furthermore, it is a known fact that the corrodibility of furfural is lower than that of organic acids.

The process of the invention can be carried out e.g. by using a tube reactor whose dimensions are $0.5<L/D<25$, preferably $1<L/D<15$. The reactor is typically lined with a zirconium or a teflon coating.

Preferably herbaceous plants are used as the raw material in the process according to the invention. Herbaceous plants generally refer to non-wood fibre sources. The most important fibre sources include straw, e.g. grain straw (rice, wheat, rye, oats, barley); hay, e.g. esparto, sabai and lemon hay; reeds, e.g. papyrus, common reed, sugar cane, i.e. bagasse, and bamboo; bast fibres, e.g. stems of common flax and oil flax, kenaf, jute and hemp; leaf fibres, e.g. manilla hemp and sisal, and seed hair, such as cotton and linter fibres of cotton. One important raw material that grows in Finland is reed canary grass.

The process of the invention is also applicable to wood material.

The following examples describe the process of the invention.

EXAMPLE 1

Wheat straw was cooked using a mixture containing 44% of formic acid, 35.2% of acetic acid and 2.5% of furfural as the cooking reagent (the rest of the mixture was water). The cooking temperature was 125° C. and the cooking time 35 min. The ratio of the cooking reagent to the raw material was 5:1.

The cooking was carried out in a Zr-lined cooking reactor whose volume was 1 litre and whose dimensions were L/D=2.56. External electric heating was used in the reactor.

Lignin was washed from the delignified pulp obtained with an acid whose concentration was 44% of formic acid and 35.2% of acetic acid. Then the pulp was washed at a temperature of 65° C. with peracid, which was prepared in situ by adding 1% of hydrogen peroxide from the weight of the fibre raw material. After the washing, the pulp was de-esterified at a temperature of 70° C., the acid concentration being 10% (4 h). Finally, the pulp was washed with water.

The pulp obtained was extracted with alkali and bleached twice with hydrogen peroxide. The brightness of the bleached pulp was 81.7 ISO (measured using the standards SCAN-CM 11:75 and SCAN-P 3:93). Its tensile strength was 57.4 kNm/kg (measured using the standard SCAN-P 67:93), and its SR was 35 (measured using the standard SCAN-CM 26:99).

EXAMPLE 2

Brown (unbleached) pulp was produced from wheat straw in the same manner as in example 1. Table 1 presents the cooking conditions with different furfural contents (% by wt.) while the kappa number of pulp is the same. The contents of furfural, formic acid (HCOOH), acetic acid ($CH_3COOH$) and water shown in the table have been calculated from the total weight of the cooking reagent (% by wt.).

It appears from the results of Table 1 that furfural improves the yield of pulp.

TABLE I

| Furfural | HCOOH | $CH_3COOH$ | Water | Cooking temperature | Cooking time | Yield *) |
|---|---|---|---|---|---|---|
| 0 | 73.8 | 10.2 | 16 | 115 | 28 | 41.0 |
| 2.5 | 71.6 | 9.9 | 16 | 115 | 32 | 42.2 |
| 5 | 69.4 | 9.6 | 16 | 115 | 46 | 43.0 |
| 0 | 52 | 30 | 18 | 125 | 30 | 43.5 |
| 2.5 | 50.4 | 29.1 | 18 | 125 | 27 | 44.5 |
| 5.0 | 48.8 | 28.2 | 18 | 125 | 27 | 45.0 |
| 5.0 | 33.5 | 44 | 17.5 | 130 | 35 | 44.0 |

*) Screened yield

EXAMPLE 3

Reed canary grass was cooked by a laboratory cooker using a mixture containing 42% of formic acid, 40% of acetic acid and 0.1% of furfural as the cooking reagent (the rest of the mixture was water). The cooking temperature was 125° C. and the cooking time 55 min.

The resulting pulp was washed and de-esterified using an acid mixture containing 13% of formic acid, 12% of acetic acid and 75% of water at a temperature of 95° C. The contents of the bound acids as per cents from the weight of the pulp are presented as a function of time in Table 2.

TABLE 2

| De-esterification time (h) | Bound HCOOH | Bound $CH_3COOH$ |
|---|---|---|
| 0 | 2.8 | 2.6 |
| 2 | 0.8 | 2.2 |
| 10 | 0.4 | 1.1 |

It appears from the results of Table 2 that the contents of the bound acids decrease as a function of time, i.e. the acids are released from their esters due to the catalytic effect of the acids.

It is obvious to a person skilled in the art that, as the technology advances, the concept of the invention can be implemented in various ways. The invention and its embodiments are thus not limited to the examples described above, but they may vary within the scope of the claims.

The invention claimed is:

1. A process for producing pulp from a fibre-based raw material, comprising the steps of:

(i) cooking a fibre-based raw material using a cooking reagent based on organic acids at a temperature of 105 to 160° C. to produce a pulp and a used cooking reagent, wherein said cooking reagent also includes furfural:

(ii) recovering said used cooking reagent from the cooking step (i), wherein the furfural in said cooking reagent is derived from said recovering step.

2. A process according to claim 1, wherein the furfural content of the cooking reagent is 0.01 to 10%. calculated from the total weight of the cooking reagent as measured at the start of the cooking step.

3. A process according to claim 2, wherein the furfural content of the cooking reagent is 1.0 to 7.5%, calculated from the total weight of the cooking reagent as measured at the start of the cooking step.

4. A process according to claim 3, wherein the furfural content of the cooking reagent is 2.5 to 7.5%, calculated from the total weight of the cooking reagent as measured at the start of the cooking step.

5. A process according to claim 1, wherein the organic acids of the cooking reagent are selected from the group consisting of formic acid, acetic acid and a mixture thereof.

6. A process according to claim 5, wherein the formic acid content of the cooking reagent is 0 to 90%, calculated from the total weight of the cooking reagent.

7. A process according to claim 5, wherein the acetic acid content of the cooking reagent is 0 to 90%, calculated from the total weight of the cooking reagent.

8. A process according to claim 5, wherein the cooking reagent contains 40 to 80% of formic acid and 8 to 50% of acetic acid, as the organic acids, calculated from the total weight of the cooking reagent.

9. A process according to claim 5, wherein the cooking reagent contains 40 to 80% formic acid and 8 to 40% acetic acid, as the organic acids, calculated from the weight of the cooking reagent.

10. A process according to claim 5, wherein the cooking reagent contains 40 to 80% formic acid and 8 to 35% acetic acid, as the organic acids, calculated from the weight of the cooking reagent.

11. A process according to claim 1, wherein the cooking temperature is 105 to 150°C.

12. A process according to claim 1, wherein the cooking time is 2to 120 min.

13. A process according to claim 1, wherein the ratio of the cooking reagent to the raw material is 2.5:1 to 10:1 in the cooking.

14. A process according to claim 1, wherein herbaceous plants are used as the raw material of pulp.

15. A process according to claim 1, wherein the cooking reagent also includes other furan compounds.

16. A process according to claim 1, wherein the cooking temperature is 105 to 140°C.

17. A process according to claim 1, wherein the recovery step of the used cooking reaaent comprises a step of evaporating the used cooking reagent to obtain a concentrated cooking liquor.

18. A process according to claim 17, wherein the furfural has been obtained by reacting the concentrated cooking liquor obtained from the evaporation of the used cooking reagent at an elevated temperature in the recovery step of said cooking reagent.

19. A process according to claim 1, wherein organic acids are chemically bound to the pulp.

20. A process according to claim 19, wherein the process also comprises a step where the organic acids chemically bound to the pulp are released by reacting the pulp at a temperature of 50 to 120° C. when the content of free acids is 2 to 90%.

21. A process according to claim 1, further comprising a step of separating organic matter having chemically bound organic acids from the pulp.

22. A process according to claim 21, wherein the step of separating the organic matter having chemically bound organic acids from the pulp comprises reacting the organic matter at a temperature of 50 to 180° C. when the content of free acids is 2 to 90%.

23. A process according to claim 1, further comprising a step of separating lignin containing chemically bound organic acids from the pulp.

24. A process according to claim 23, wherein the process further comprises a step where the chemically bound organic acids included in the lignin separated from the pulp are released by a diluted acid during precipitation of lignin.

25. A process according to claim 1, wherein the process is carried out in a cooking reactor.

26. A process according to claim 25, wherein a tube reactor whose dimensions are $0.5<L/D<25$, is used as the cooking reactor.

27. A process according to claim 25, wherein a tube reactor whose dimensions are $1<L/D<15$ is used as the cooking reactor.

* * * * *

UNITED STATES PATENT AND TRADEMARK OFFICE

CERTIFICATE OF CORRECTION

PATENT NO. : 7,097,738 B2
APPLICATION NO. : 10/483700
DATED : August 29, 2006
INVENTOR(S) : Rousu et al.

It is certified that error appears in the above-identified patent and that said Letters Patent is hereby corrected as shown below:

Column 8,
Line 2, "reaaent" should read --reagent--.

Signed and Sealed this

Ninth Day of January, 2007

JON W. DUDAS
*Director of the United States Patent and Trademark Office*